US006998528B1

(12) United States Patent
Limacher et al.

(10) Patent No.: US 6,998,528 B1
(45) Date of Patent: Feb. 14, 2006

(54) MULTI-CHANNEL NONLINEAR PROCESSING OF A SINGLE MUSICAL INSTRUMENT SIGNAL

(75) Inventors: Olivier Limacher, Westlake Village, CA (US); Marcus Ryle, Westlake Village, CA (US); Michel Doidic, Westlake Village, CA (US); Carol A. Hatzinger, Newbury Park, CA (US)

(73) Assignee: Line 6, Inc., Agoura Hills, CA (US)

( * ) Notice: Subject to any disclaimer, the term of this patent is extended or adjusted under 35 U.S.C. 154(b) by 0 days.

(21) Appl. No.: 10/840,340

(22) Filed: May 5, 2004

Related U.S. Application Data

(63) Continuation of application No. 10/197,008, filed on Jul. 16, 2002, now Pat. No. 6,881,891.

(51) Int. Cl.
*G10H 5/02* (2006.01)
*G10H 7/00* (2006.01)

(52) U.S. Cl. ..... 84/662; 84/664

(58) Field of Classification Search ..... 84/601–607, 84/621, 626–633, 662–665
See application file for complete search history.

(56) References Cited

U.S. PATENT DOCUMENTS 4,038,898 A 8/1977 Kniepkamp et al.
4,369,336 A 1/1983 Agnello
4,384,505 A 5/1983 Cotton, Jr. et al.
5,133,014 A 7/1992 Pritchard
5,241,129 A 8/1993 Muto et al.
5,570,424 A 10/1996 Araya et al.
5,727,069 A 3/1998 Hughes et al.
5,789,689 A 8/1998 Doidic et al.
6,091,013 A 7/2000 Waller, Jr. et al.

OTHER PUBLICATIONS

Vetta Series, "A New Concept in Guitar Amplification", Line 6 Winter/Spring 2002 Product Catalog.
Line 6 Demos Vetta Guitar Amplifier, Press Release, NAMM Booth #2015 & 2019, Jul. 20, 2001.
Line 6 Ships Vetta Combo Amplifier and FBX Foot Controller, Press Release, Nov. 27, 2001.

*Primary Examiner*—Jeffrey W Donels
(74) *Attorney, Agent, or Firm*—Blakely, Sokoloff, Taylor & Zafman LLP

(57) ABSTRACT

Multiple channels simultaneously provide multiple, modified digital audio signals, respectively, based on the same digital audio input signal. Each channel has a respective nonlinear effects section to apply a nonlinear transfer function, such as one that emulates a vacuum tube guitar amplifier, based on the input signal. In addition, a respective audio effects section is provided in each channel to apply an audio effect, such as a linear audio effect, based on the input signal. This audio effect is set in each channel by a controller. In another embodiment, multi-tracker (e.g., double tracker) functionality is provided by the multiple channels wherein at least one of the delay effect, pitch shift, and gain change in a channel is automatically changed as a function of the input signal.

5 Claims, 9 Drawing Sheets f 9

MULTI-CHANNEL NONLINEAR PROCESSING OF A SINGLE MUSICAL INSTRUMENT SIGNAL

This application is a continuation of Ser. No. 10/197,008, filed on Jul. 16, 2002, now U.S. Pat. No. 6,881,891, entitled "Multi-Channel Nonlinear Processing of a Single Musical Instrument Signal."

BACKGROUND

The various embodiments of the invention are related to electronic instrument amplifiers and more particularly to those that use digital techniques to emulate the generation of multiple simultaneous musical performances, e.g. double tracking.

In recording studios, the sound of a musical instrument is fattened or enhanced by over-dubbing several times the same part played using the instrument. Every instance of the performance differs from the others by subtle shifts in timing and tone. The blending of the different takes of the same musical part leads to some random chorusing and fluttering which makes for the sought-after character of this effect. One possible variation of this chorus technique is called double tracking in which only two takes of the performance are combined. Each take can receive independent processing such as distortion, filtering, etc., and the pair is then placed symmetrically in the stereo imaging space.

In contrast to the recording studio, double tracking in a live performance situation typically requires two performers playing the same musical part. That is because over-dubbing is not practical in a live performance. A more practical solution may be to use an electronic chorus generation system. For example, U.S. Pat. No. 4,369,336 describes how a chorus effect is formed, by a pair of complementary digital signals based on an original, analog audio signal. Another system is described in U.S. Pat. No. 4,384,505, where a string chorus generator accepts a single audio input signal, applies it to three separate delay lines, and provides delay modulated outputs to produce an ensemble musical effect resembling a group of strings in a string orchestra.

BRIEF DESCRIPTION OF THE DRAWINGS

The invention is illustrated by way of example and not by way of limitation in the figures of the accompanying drawings in which like references indicate similar elements. It should be noted that references to "an" embodiment of the invention in this disclosure are not necessarily to the same embodiment, and they mean at least one.

DETAILED DESCRIPTION

Figure 1:
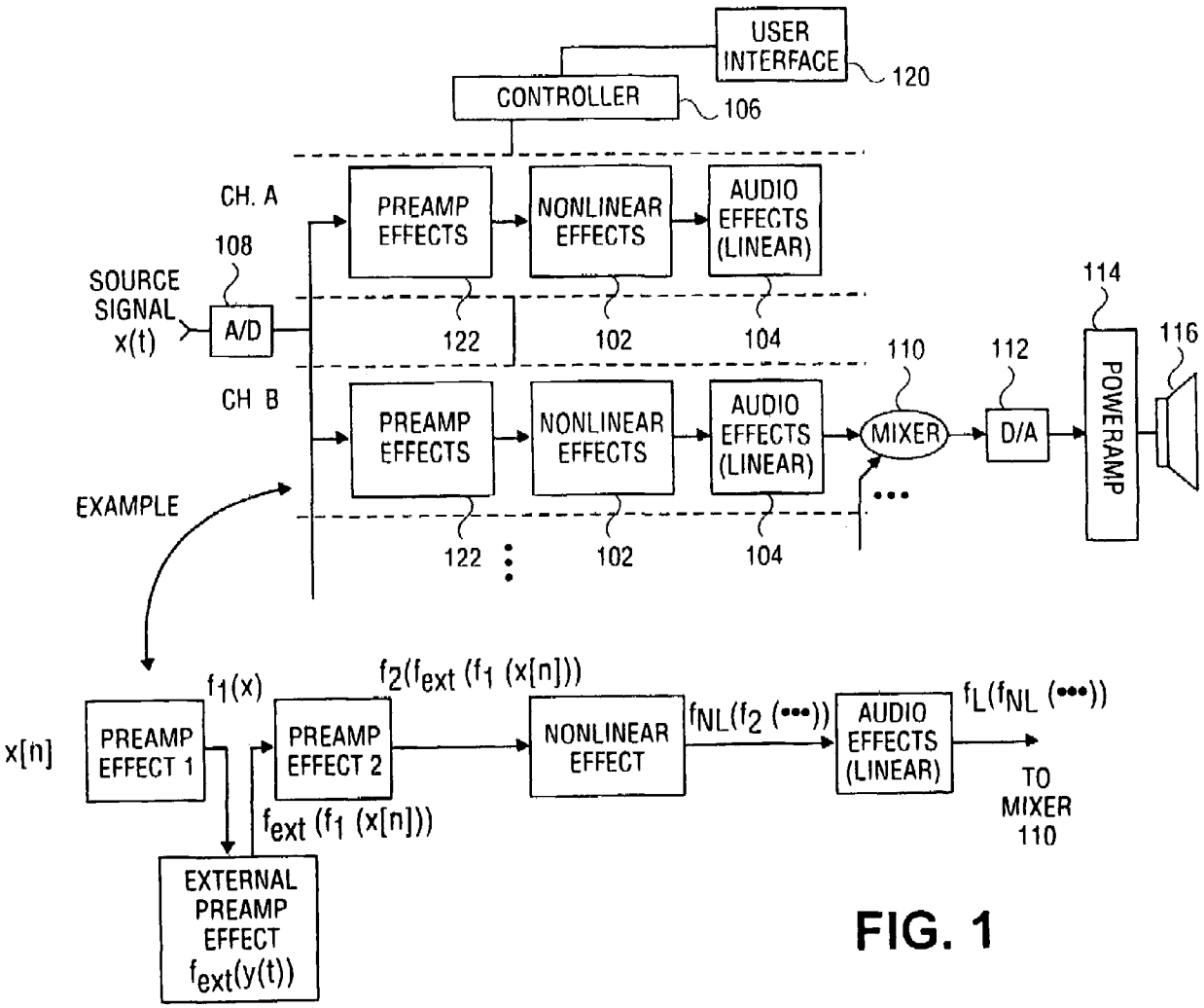
FIG. 1 shows a logical block diagram of an embodiment of an instrument amplifier capable of emulating multiple, different nonlinear effects and combining them into an ensemble musical effect.

Various embodiments of an instrument amplifier are described below that allow the digital emulation of multi-tracking (e.g., double tracking) and nonlinear effects in instrument amplifiers. Referring first to FIG. 1, what is shown is a logical block diagram of an embodiment of the instrument amplifier capable of emulating multiple, different nonlinear effects and combining them into an ensemble musical effect. A number of channels simultaneously provide a corresponding number of modified, digital audio signals, respectively, based on the same digital audio input signal. This digital audio input signal may be provided by an analog to digital converter 108 in response to digitizing an analog source signal at its input. The analog source signal may be an instrument signal, such as an electric guitar signal that has been generated by an electromagnetic pick-up located on the actual guitar (not shown in FIG. 1). Alternatively, the source signal may originate from other types of musical instruments such as a banjo, violin, etc.

The instrument amplifier has two or more channels, in this case labeled channel A, channel B, . . . , where each channel has a respective nonlinear effects section 102 to apply a nonlinear transfer function based on the digital audio input signal. In addition, each channel has a respective audio effects section 104 to apply an audio effect based on the digital audio input signal.

The nonlinear effect section 102 is a discrete time system that applies nonlinear transfer functions to an input sequence. An example of a nonlinear function is a distortion producing function which emulates high-gain tube amplifier distortion. For tube amplifier distortion, these functions may replicate the transfer function of a variety of tube amplifier types, as well as the transfer function of "fuzz" distortion effects and hard-clipping. The transfer functions, which may be specified in discrete time domain, may also emulate well known commercially available tube amplifiers such as the Fender Twin Reverb™, Fender Bassman™, Marshall JCM 800™, Vox AC30™, and Mesa Boogie Dual Rectifier™ just to name a few.

The nonlinear function may be applied to each value of the digital audio input signal to yield a new sequence. Care should be taken that aliasing or fold over noise not be introduced in the application of the nonlinear function, as discussed in U.S. Pat. No. 5,789,689 to Doidic ("the Doidic patent"). One way to avoid such aliasing or fold over noise is to have a sufficiently high sampling frequency at the analog to digital converter 108. Another way is to use an oversampling technique in the nonlinear effects section 102, also as described in the Doidic patent.

The nonlinear effects section 102 may apply any number of basic functions which may also include linear functions. As an example, the nonlinear effects section may be configured to apply three nonlinear transfer functions as described below. The first is $$f(x)=(|2x|-x^2)\sin(x)$$

where sin(x)=1 if x>0 and sin(x)=1 otherwise

This transfer function closely tracks the effects of a tube amplifier. In other words, it behaves similarly to the transfer function of a tube amplifier.

A second transfer function emulates hard clipping, and is used to model "fuzz" effects, giving a harsh distortion. The hard clipping transfer function may be $$f(x)\begin{cases} Kx & \text{if } |x| < MaxValue \\ \sin(x)\cdot K\cdot MaxValue & \text{otherwise.} \end{cases}$$

A third transfer function which is used to model several tube preamps is a piecewise function in which there are three distinct regions making up a curve, over the domain −1<=x<=1. In the first region of this function $$f(x) = -\frac{3}{4}\{1-[1-(|x|-0.032847)\wedge 12+1/3(|x|-0.032847)]+0.01\}$$

$$\text{for } x < -0.08905.$$

$$f(x)=-6.152x^2+3.9375x$$

where $$-0.08905<x<0.320018.$$

In the third region f(x)=0.60035 where x>0.320018. Other nonlinear functions work quite well also, and may even be defined piecewise over multiple regions of the domain. A basic constraint on f(x) may be that it be a piecewise continuous function defined for every point in the domain.

The audio effects section 104 applies functions that are conventionally found in digital audio instrument processors. The combined audio effect in each channel may be selected from a number of different linear or nonlinear audio effects that include auto volume, graphic equalizer, tremolo, delay, reverb, and cabinet simulator, just to name a few. One or more of these functions are applied based on the digital audio input signal, either prior to or after the application of the nonlinear functions, by the nonlinear effects section 102. In addition, multiple audio effects may be applied sequentially, based on the same digital audio input signal, to result in a combined audio effect. An example of the details of an audio effects section is described in the Doidic patent.

Still referring to FIG. 1, a controller 106 is coupled to the channels to set the audio effect in each channel. This controller 106 may be a simple mechanical switch, a selector circuit, or a programmable microcontroller that instructs the audio effects section 104 of each channel, independently, of the desired combination of audio effects. Thus, the combination audio effect in a given channel may be set independently of the combination audio effect in another channel, via the controller 106. Similarly, the nonlinear transfer function to be applied in a given channel by a nonlinear effects section 102 can be set independently of the nonlinear function to be applied in another channel. This gives the user tremendous flexibility in experimenting with a single instrument amplifier to obtain a wide range of different sounds from a single source signal.

The embodiment of the instrument amplifier shown in FIG. 1 achieves an ensemble sound effect using a digital mixer 110 that is coupled to an output of each channel. The mixer 110 provides a combined digital audio signal at its output, based on the multiple modified digital audio signals from the channels, using conventional digital audio mixing techniques. Although in all the figures here only one line is drawn to represent a mixer output, this also represents the alternative of multiple output signals, as in a stereo output. Although not explicitly shown in FIG. 1, the controller 106 may be further coupled to the mixer 110 to set a variety of mixing parameters such as pan control, fader, and equalizers, just to name a few. The combined digital audio signal provided by the mixer 110 reflects a combination of the modified digital output signals from one or more of the channels. This output digital signal may then be converted to analog form using a conventional digital to analog converter 112. The resulting combined analog signal may be fed to a power amplifier 114 that may be a solid state linear amp, i.e., without the distortion typical of tube amplifiers. The output of the amplifier is then fed to a loud speaker 116 which in turn provides a sound based on the amplified, combined signal. In the stereo embodiment, each of the stereo output signals from the mixer 110 can be independently amplified.

Continuing to refer to FIG. 1, in certain embodiments of the instrument amplifier, each of the channels may further include a respective preamp effects section 122, to apply a preamplifier effect, again based on the digital audio input signal. The preamp effect can be determined by the controller 106 to be at least one of a number of different preamp effects which may include hum canceler, noise gate, dynamic compressor, volume control, wah, phase shifter, and bright switch, to name a few. The preamp effects section is a digital implementation of a variety of analog-style effects that a typical musical instrument player might use to alter the tonality of the musical instrument prior to amplification. A number of these effects sections may be connected in series, forming a chain of multiple preamp effects.

Additional tonal variation may be obtained by changing the order of certain effects. In addition, the preamp effects may include an effects loop to send data to and receive data from equipment that is external to the instrument amplifier. Examples of such effects loop are those found on conventional audio mixers wherein an audio signal is sent out on an effects send jack, processed externally, and returned to the mixer via an effects return jack. Examples of external processing effects that may be used by guitarists are "univibe" vibrato effects, pitch shifting effects, etc. After the digital audio input signal is routed through a number of effects in the chain, the output of a preamp effect is sent to an appropriate data converter whose output may then be sent to an external processor (not shown). This conversion may be into analog form as many conventional effects equipment provide the preamp effect based on an analog signal. After the preamp effect has been applied externally, the analog signal is returned to the instrument amplifier and converted back into digital form. Once in digital form again, the signal is routed through the remaining effects in the chain of the instrument amplifier. FIG. 1 shows an example of such a chain of functions being applied to an input time domain sequence x[n]. In general, a wide range of different combinations of preamp effects, nonlinear effects, and linear audio effects may be provided in the instrument amplifier with the added capability of setting the different effects via the controller 106.

The logical block diagram of the instrument amplifier shown in FIG. 1 may represent a standalone amplifier that has a portable housing in which all of the physical components needed for implementing the functionality shown in FIG. 1 are installed. These components could further include a user interface 120 which could be any combination of knobs and a display panel that allow a user to give the controller 106 his or her desired selection of effects. Also, some of the components may be located external to the instrument amplifier's housing. For instance, the channels, the controller 106, the digital mixer 110, the digital to analog converter 112, the power amplifier 114, and the loud speaker 116 may all be installed in the housing, while the analog to digital converter 108 is not. Instead, an interface circuit (not shown) can be installed in the housing to provide the digital audio input signal, based upon a source signal that is generated outside the housing. The digitization of this source signal may thus be performed either in the housing or external to it. Similarly, the digital to analog converter, the power amplifier 114, and the loud speaker 116 may be moved outside the housing, thereby allowing the portable housing to be physically smaller and require only a digital signal interface to the input and output audio signals.

The digital implementation of the preamp effects section 122, the nonlinear effects section 102, and the linear audio effects section 104 described above may be according to any number of well known techniques. For example, a programmed processor or set of processors may be used to apply the functions of each effects section, based upon the digital audio input signal being a discrete time sequence. The application of the various transfer functions may be in the time domain, in the frequency (z) domain, or a combination of both. A machine-accessible medium will include data that, when accessed by a machine (such as one or more processors), cause the machine to perform various operations, including the application of the various effects mentioned above. This medium also is understood to refer to any mechanism that provides (i.e., stores and/or transmits) information in a form that is accessible by a computer, network device, personal digital assistant, manufacturing tool, or any other device with a set of one or more processors. A machine accessible medium maybe read only memory or ROM; random access memory or RAM; magnetic disk storage media; optical storage media; flash memory devices; or a combination thereof. For increased performance, at least some of the digital implementation of the different effects may be done in hard wired logic through the use of programmable gate arrays or custom digital integrated circuits. These possibilities also apply to the implementation of the digital mixer 110.

Figure 2:
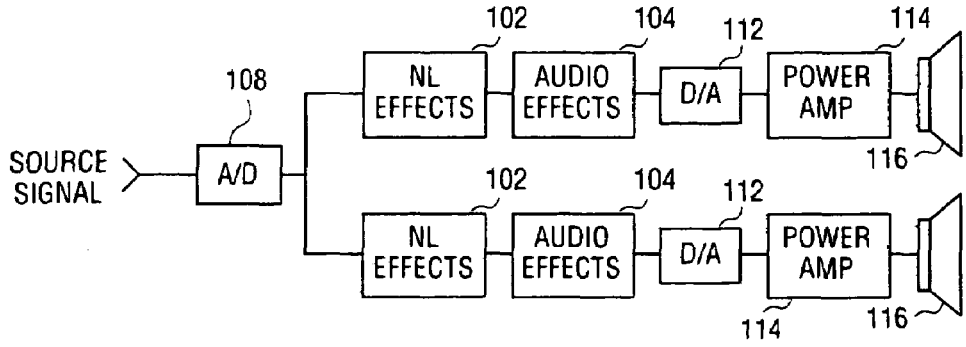
FIG. 2 illustrates a diagram of an instrument amplifier in which each channel has separate digital to analog, power amplifier, and loud speakers to achieve the ensemble musical effect.

Referring now to FIG. 2, another embodiment of the instrument amplifier is shown, where in this case there are only two channels that contribute to the ensemble musical effect. Other differences between the instrument amplifier depicted in FIG. 2 and that of FIG. 1 are the absence of the digital mixer 110 and the separate digital to analog converters 112, power amplifiers 114 and loud speakers 116 for each channel.

Figure 3:
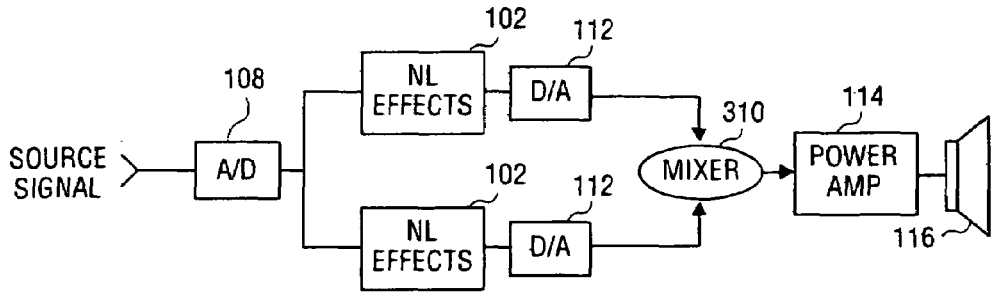
FIG. 3 shows a diagram of an instrument amplifier that features analog mixing.

In the embodiment of FIG. 3, the instrument amplifier has, once again, only two channels but, in addition, also has the audio effects section 104 eliminated. This embodiment has dual digital to analog converters 112 which feed a conventional analog audio mixer 310. Again, the mixer 310 may have dual output signals, as in a stereo application, which are then independently amplified.

Figure 4:
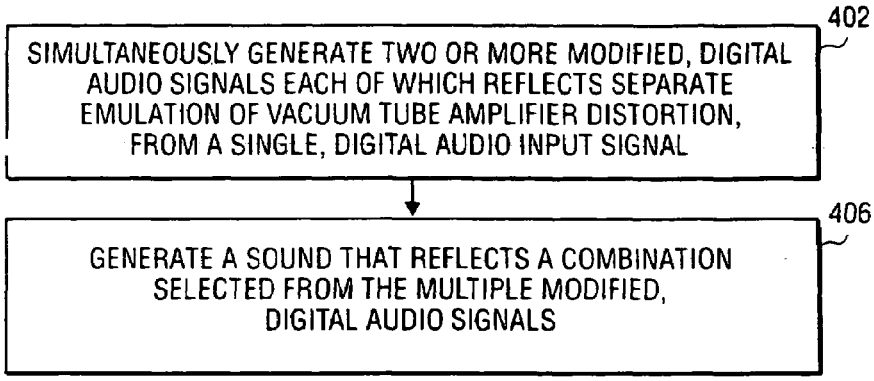
FIG. 4 depicts a logical flow diagram of a method for achieving an ensemble musical effect by emulating multiple vacuum tube amplifiers.

A method for achieving an ensemble musical effect is depicted in flow diagram form in FIG. 4. In operation 402, two or more modified, digital audio signals are simultaneously generated. Each signal reflects separate emulation of a nonlinear effect such as vacuum tube amplifier distortion, from a single, digital audio input signal. In operation 406, a sound that reflects a combination selected from the multiple, modified digital audio signals is generated. The emulation of vacuum tube amplifier distortion as well as any other preamp and linear audio effects are in digital form. The generation of the sound that reflects the combination may be according to a variety of different techniques including for instance digital mixing followed by power amplification, analog mixing followed by power amplification, and no mixing but rather providing separate amplification and loudspeakers for each channel.

Figure 5:
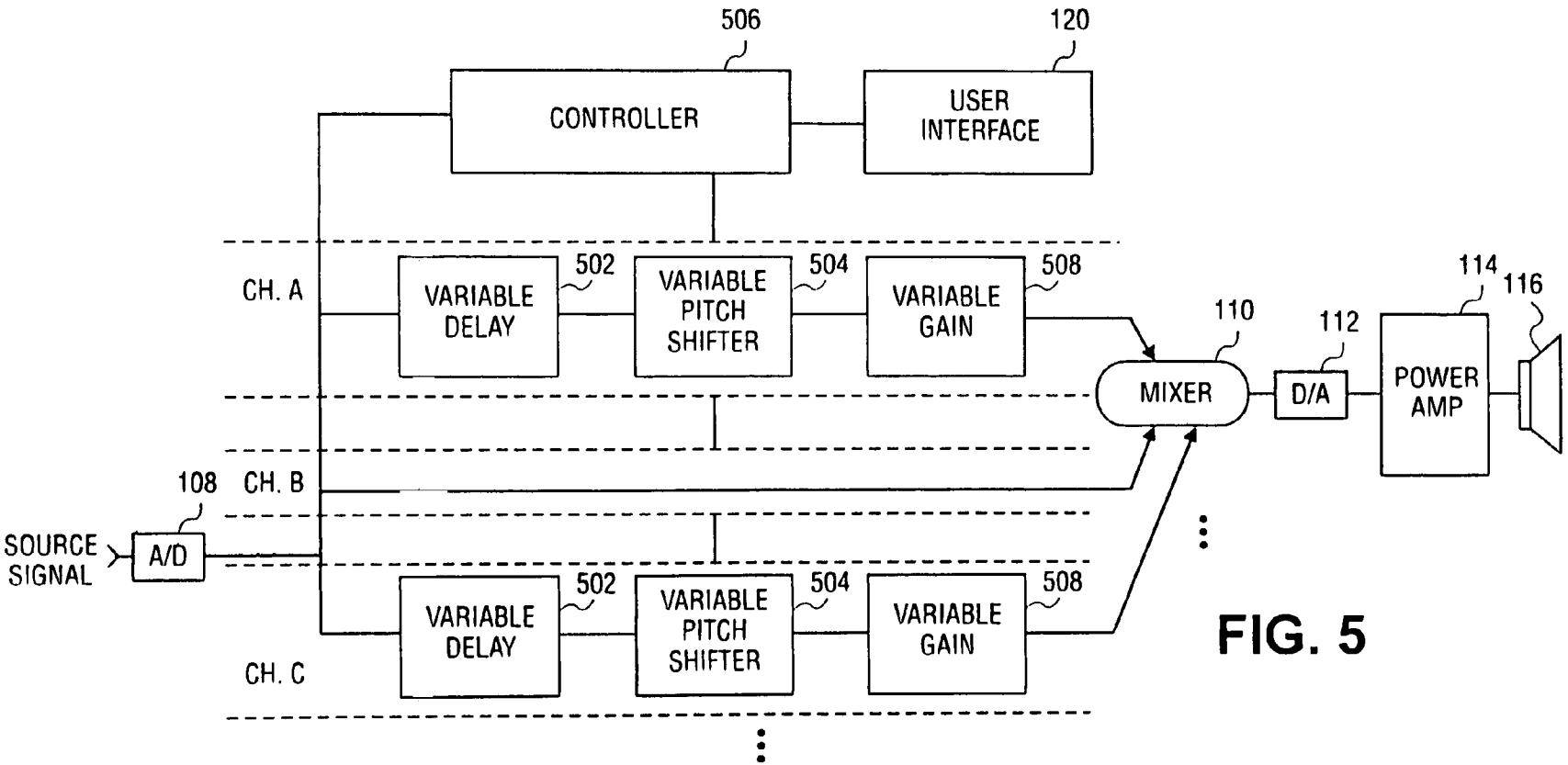
FIG. 5 shows a diagram of an instrument amplifier capable of digitally emulating a double tracker effect.

The above-described embodiments of the instrument amplifier are expected to generate a sound by a combination of modified digital audio signals that reflect digital emulation of nonlinear as well as other types of audio and preamp effects. FIG. 5 shows another embodiment of the instrument amplifier in which multiple channels are again used, however this time they are to perform a digital emulation of a multi-tracker such as a double tracker. The embodiment of FIG. 5 has at least two channels, namely channels A and B, each of which is to simultaneously provide a digital audio signal, respectively, based on the same digital audio input signal. Once again, this digital audio input signal is obtained from the output of an A/D converter 108 that digitizes a source signal such as an analog, electric guitar signal. At least one channel, for example channel A, is to render a delay effect, a pitch shift, and a gain change based on the digital audio input signal. This rendering is accomplished using a chain of variable delay section 502 followed by a pitch shifter section 504 and a variable gain section 508. Note that channel B in this embodiment is illustrated by a simple line, which represents a channel in which either no delay (or a fixed delay), no pitch shift, and no change in gain is introduced, relative to the digital audio input signal. A controller 506 is coupled to each channel, except maybe channel B which need not be "controlled", to change the delay effect, the pitch shift, and/or the gain change, all as a function of the digital audio input signal. Note that a function of this controller 506 is somewhat different than the controller 106 described earlier in that the controller 506 is responsible for automatically changing at least one of the delay effect, the pitch shift and the gain change as a function of the digital audio input signal. Note that all three need not be changed each time the channel characteristics are updated.

The embodiment of FIG. 5 also has a mechanism for combining at least two of the digital audio signals provided by the different channels of the instrument amplifier. This may be achieved using, for example, a digital mixer 110 as shown. As an alternative, an analog mixer may be used where it is preceded by digital to analog converters 112 on each channel (not shown). A combination of multiple digital audio signals is converted into sound by means of a loudspeaker 116, where a power amplifier 114 may also be introduced to obtain a louder sound.

Figure 6:
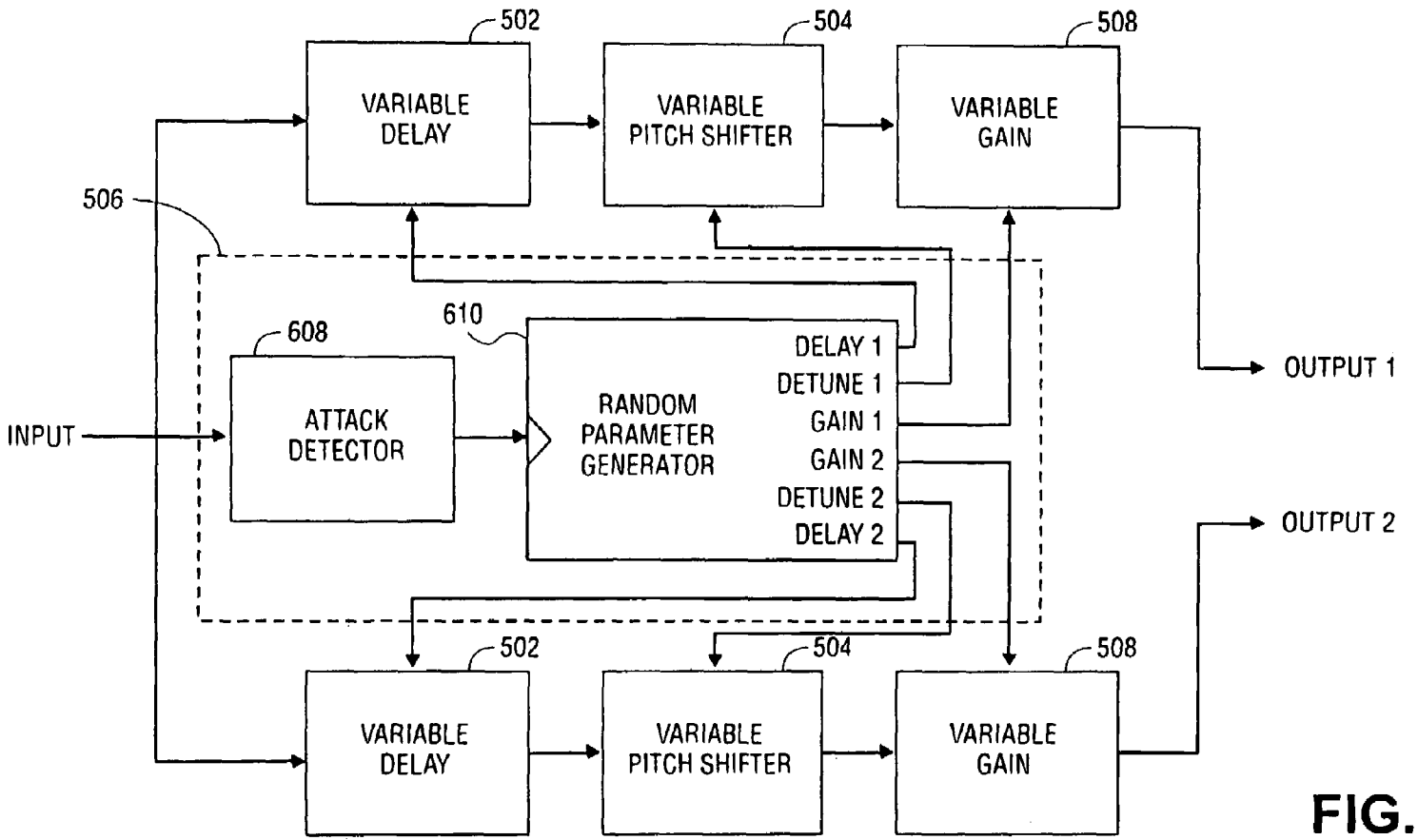
FIG. 6 illustrates another embodiment of the digitally emulated double tracker.

According to an embodiment of the instrument amplifier, the controller 506 features an attack detector 608 as seen in FIG. 6. The attack detector 608 is to operate based on the digital audio input signal, and the controller is to change one or more of the delay effect, the pitch shift, and the gain change of a channel in response to an attack being detected from the digital audio input signal. The controller 506 may be coupled to control at least two channels so that a change made to one or more of the delay effect, the pitch shift, and the gain change in one channel is different than a corresponding change in the second channel. In other words, when an attack has been detected, the controller 506 alters the delay, pitch shift, and/or gain characteristics of the different channels in different ways. One way to effect such a change is to provide the controller 506 with a random parameter generator 610 that generates randomly distributed delay effect, pitch effect and/or gain effect values that are to be applied to the different channels to determine the delay effect, the pitch shift, and the gain change in those channels. Each parameter may be defined to be within a range set by the user, via a user interface 120 (see FIG. 5), and the random pattern generator generates parameter values that are randomly distributed within these ranges. The use of such a random parameter generator to alter the channel characteristics helps obtain a more natural sounding ensemble musical effect from the instrument amplifier.

It has been determined that a better ensemble sound effect may be obtained by changing one or more of the three parameter values for a given channel only if an attack has been detected in the digital input audio signal.

Figure 7:
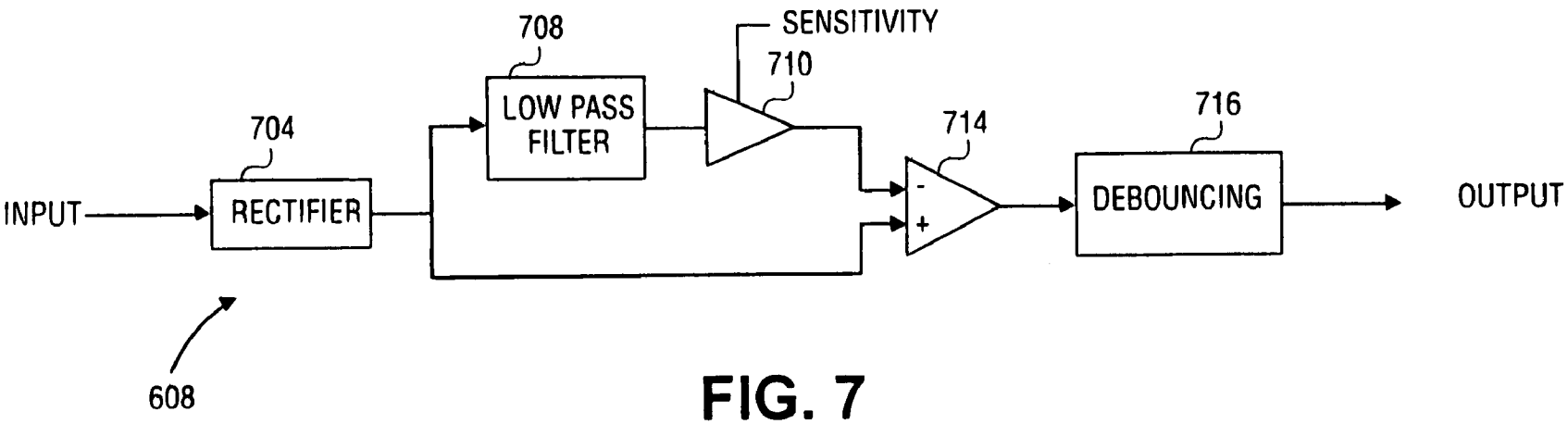
FIG. 7 shows a diagram of an attack detector that can be used in the digitally emulated double tracker.

Turning now to FIG. 7, what is shown is a logical block diagram of a time domain attack detection scheme whose input is the digital audio input signal and whose output provides a trigger pulse that is fed to the random pattern generator 610 (see FIG. 6). A rectifier 704 receives the digital audio input signal and provides an envelope signal that is fed to a low pass filter 708 whose output in turn feeds an amplifier 710 with variable gain. The output of the amplifier 710 is compared to an unfiltered version of the envelope signal by a comparator 714. The output of the comparator 714 is fed to a debouncing section 716 which yields a usable trigger pulse whenever an attack has been detected. Note that the gain of the amplifier 710 acts as a sensitivity parameter. The debouncing section 716 at the output is used to avoid multiple triggering during the rise of the attack. Other attack detection schemes, however, can alternatively be used.

Figure 8:
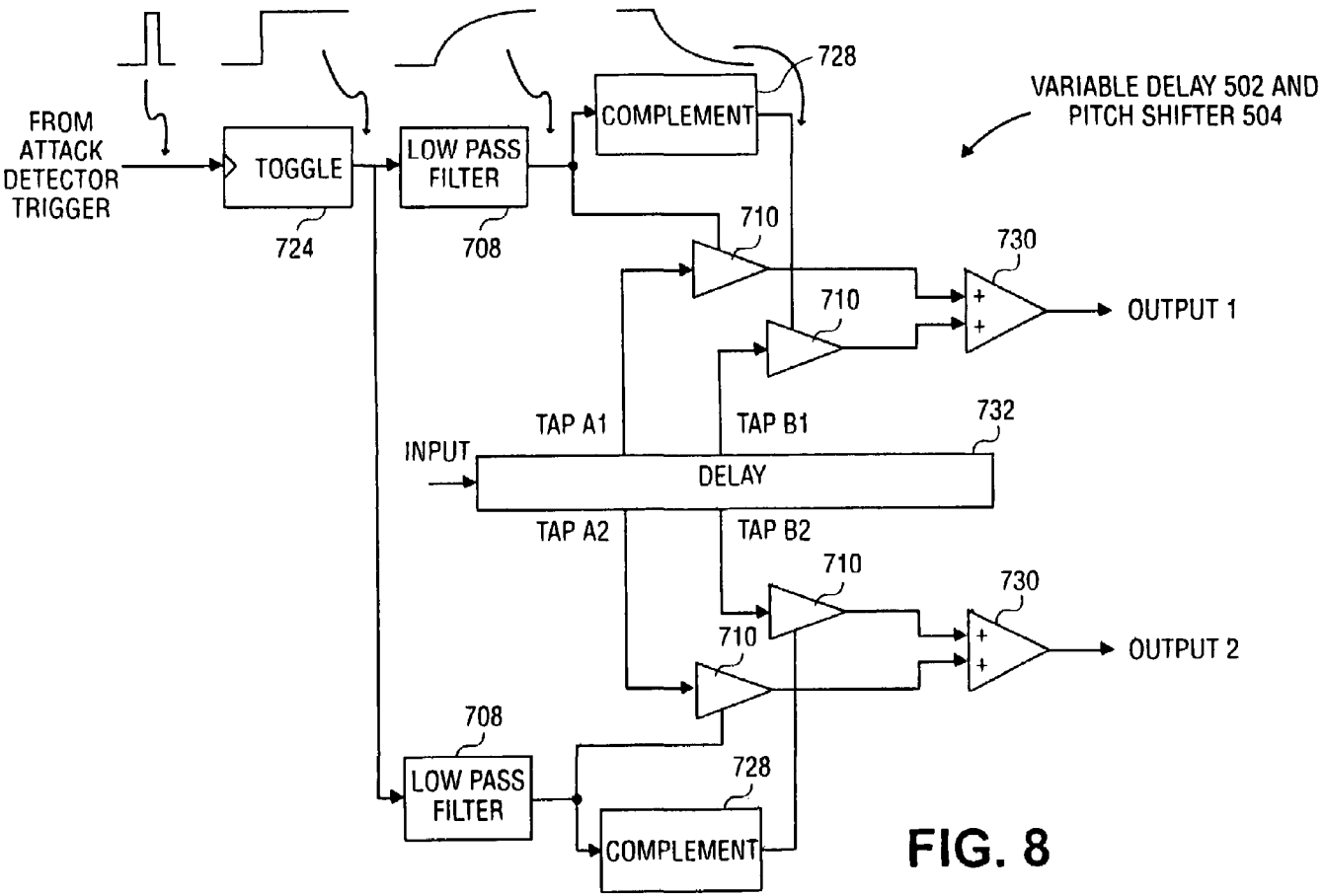
FIG. 8 illustrates a diagram of another embodiment of the delay and pitch shifter components of the digitally emulated double tracker.

Referring now to FIG. 8, what is shown is a logical block diagram of a particular implementation of the variable delay section 502 and pitch shifter 504 in two channels. Note that the variable gain block 508 (see FIG. 6) is not shown in FIG. 8, but may be placed anywhere in the chain of processing blocks shown in FIG. 8 if the entire process is linear. The output from the attack detector is an impulse that is fed to the clock input of a toggle circuit 724 which may be a flip flop. The output of the toggle circuit 724 is fed to a pair of low pass filters 708 whose outputs in turn control the sensitivity or gain of separate amplifiers 710. In addition, a complement circuit 728 is provided to reverse the output of the low pass filter and feeds another amplifier 710. Thus, the sensitivity or gain of the two amplifiers 710 for each channel are swept in opposite directions in response to a pulse from the attack detector. The inputs to each pair of amplifiers 710 tap into the delay line at locations A and B as shown. These tapped values (following a scalar adjustment by the amplifiers 710) are then fed to a respective adder circuit 730 in each channel which then provide the modified digital output signals for each channel. This is an example of a cross fading circuit implemented using mostly digital components, although an alternative would be to implement the circuit using analog components if desired. The cross fading of instantly switching delays (note that the tap location on the delay line 732 can change instantly, i.e., from one sample of the input to the next, as a function of the delay parameter) is a preferred method that allows pitch stable and smooth time shifts.

Figure 9:
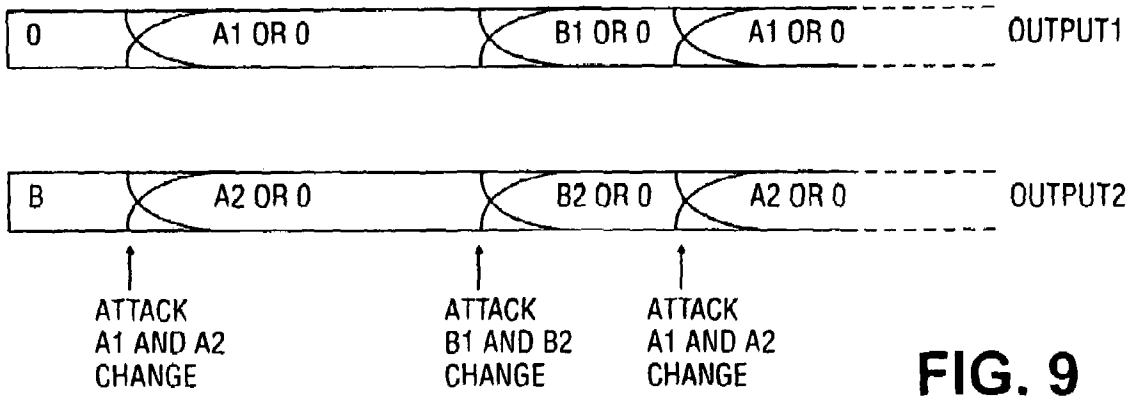
FIG. 9 depicts crossfade envelopes happening at the two outputs of the emulated double tracker.

Operation of the cross fading circuit may be described using the crossfade envelope in FIG. 9, where it should be understood that A1 and A2 are not allowed to both be non-zero at any time, but rather one of them is forced to zero at all times. Similarly, B1 and B2 cannot both be non-zero at any time, and either B1 or B2, but not both, has to be zero at all times. This helps minimize the overall latency of the circuit. Also, note that only the A delays or the B delays, but not both, change for any given pulse received from the attack detector. In addition, it is preferred that the A and B delays change alternately, as depicted in the time domain waveforms of FIG. 9.

Figure 10:
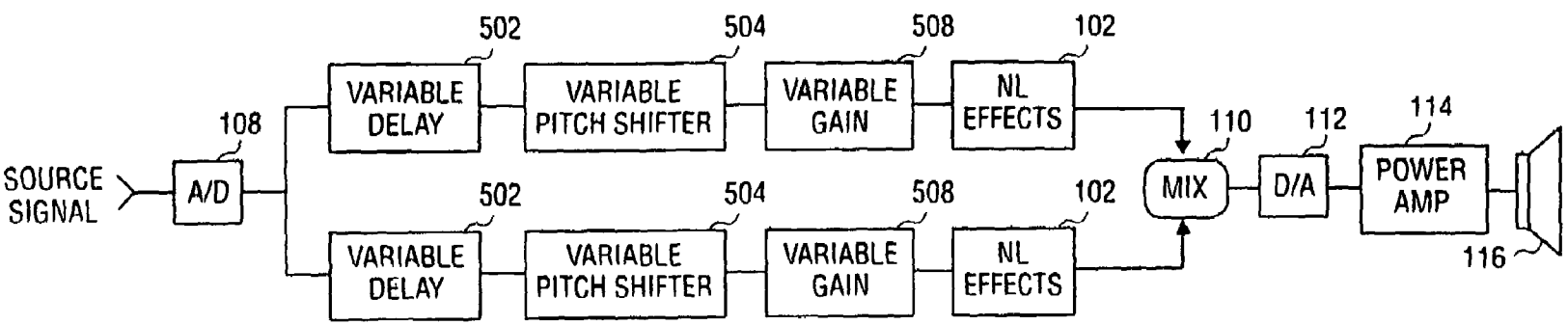
FIG. 10 shows a diagram of an instrument amplifier that can emulate a double tracker and multiple, different nonlinear effects.

Turning now to FIG. 10, what is shown is a logical block diagram of an embodiment of the instrument amplifier that can emulate an ensemble musical effect using two parallel channels for digital processing based on the same digital audio input signal obtained once again from the analog to digital converter 108. Although only two channels are shown in the embodiment of FIG. 10, additional channels may be added in parallel with the two that are shown. Each channel has the following components: variable delay section 502, variable pitch shifter 504, variable gain 508, and nonlinear effects section 102. Additional digital processing sections, such as a linear audio effects section and/or a preamp effects section, may be introduced into one or more channels. In the embodiment shown in FIG. 10, the modified digital output signal from each channel is fed to a digital mixer 110 before being converted to analog form, amplified, and converted into sound. Alternatives to digital mixing are to use an analog mixer after converting the output of each channel into an analog signal, or to avoid a mixer altogether and feed each channel to a separate power amplifier and speaker combination.

The variable delay section 502 and pitch shifter section 504 may be implemented by the digital technique described above in connection with FIG. 8. The variable gain section 508 and the nonlinear effects section 102 may also be implemented using a digital scheme in which each sequence value of the digitized audio input signal is modified according to a gain value or according to a nonlinear transfer function. This nonlinear transfer function may be, for instance, one that emulates distortion in a vacuum tube amplifier such as an electric guitar tube amplifier, where in that embodiment the source signal may be an analog signal originating from an electromagnetic pickup on an electric guitar. Such a source signal may be a combo signal in which the vibration of all six strings of a guitar (or alternatively all four strings of a bass guitar) is reflected in a single signal.

Figure 11:
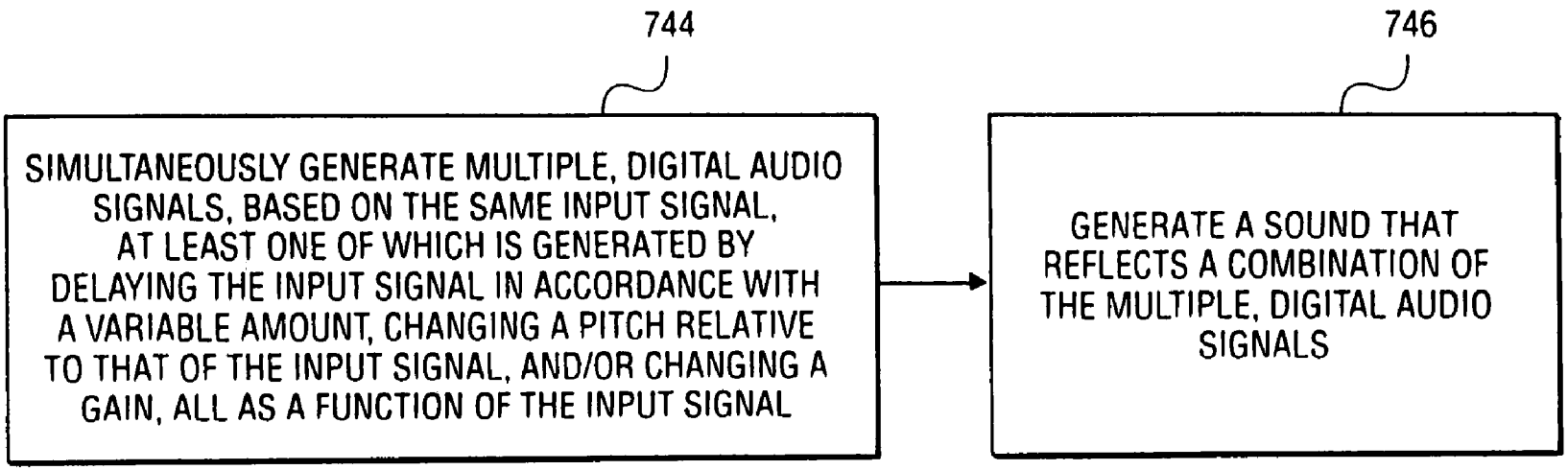
FIG. 11 illustrates a flow diagram of a method for emulation of multi-tracking.

FIG. 11 shows a flow diagram of a method for achieving an ensemble musical effect using a single instrument amplifier. In operation 744, multiple, digital audio signals are simultaneously generated, based on the same input signal. At least one of these digital audio signals is generated by delaying the input signal in accordance with a variable amount, changing a pitch relative to that of the input signal, and/or changing a gain, all as a function of the input signal. For example, one, two, or all three changes may be made, only in response to an attack being detected in the input signal. In addition, changes to the delay, pitch, and gain may be different across different ones of the digital audio signals. A sound that reflects a combination of these multiple, digital audio signals is then generated (operation 746). Such a sound may be produced by, for example, separate loudspeakers that receive separately amplified versions of the digital audio signals. Alternatively, the sound may be generated by a loudspeaker in response to a combination of the multiple digital audio signals, where this combination has been converted into analog form before being amplified and fed to the speaker.

Figure 12:
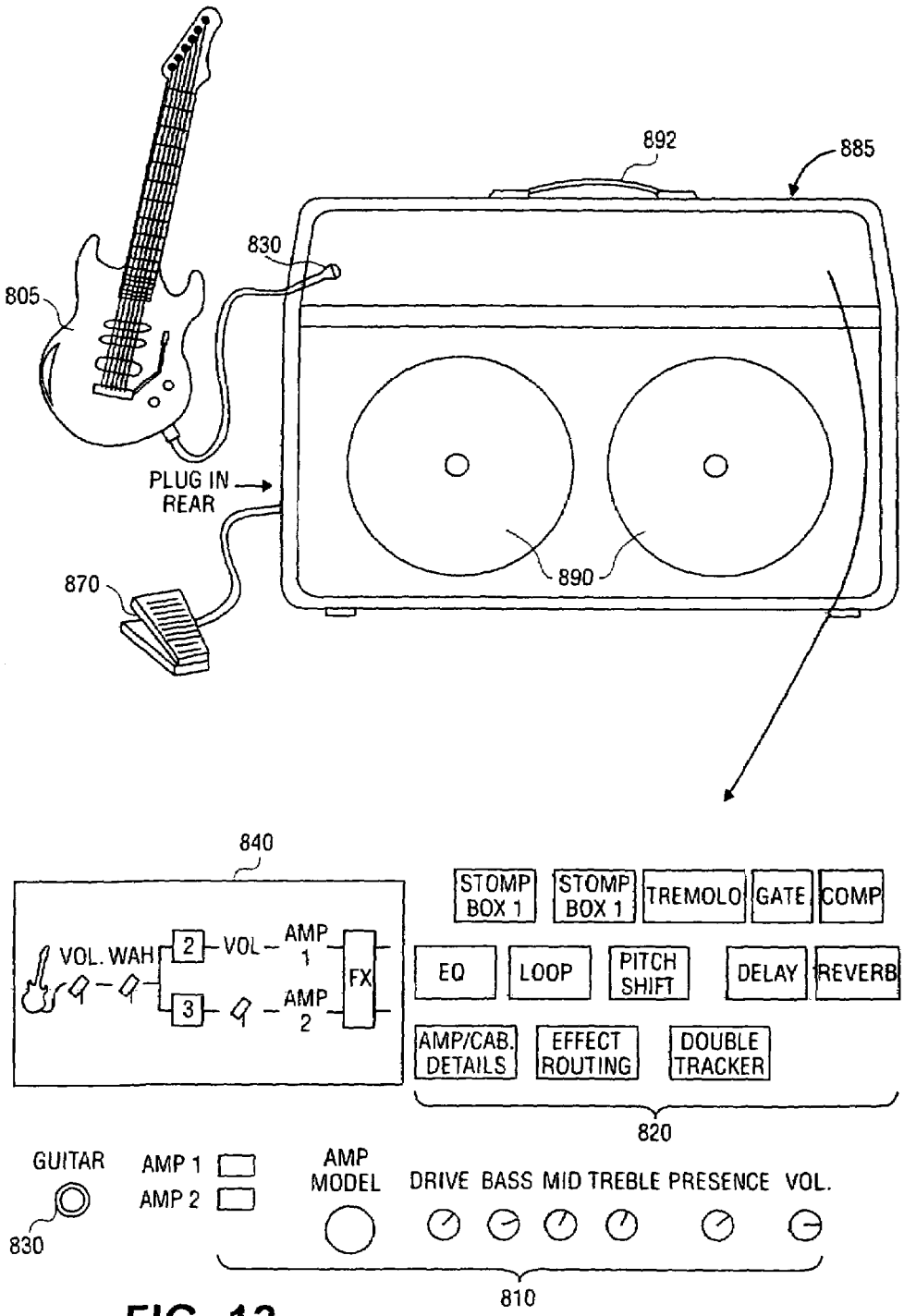
FIG. 12 depicts an illustration of a portable electric guitar amplifier as an application of the instrument amplifiers which can digitally emulate a double or multi-tracking effect and/or an emulation of an ensemble of different vacuum tube amplifiers.

Referring now to FIG. 12, what is shown is a picture of an application of the instrument amplifier. The application features an electric guitar 805 whose signal output is connected to a guitar input jack 830 by way of a cable as shown. As an alternative to a cable, a wireless link may be provided with a transmitter installed on the guitar 805 and a receiver installed in the housing 885, for transmitting the guitar signal over a wireless medium. As mentioned above, this guitar signal may be in analog or digitized form. The input jack 830 is installed on a portable instrument amplifier housing 885 which contains a pair of 12" loud speakers 890 and a handle 892. Program selection and storage for, in this case, two channels, are performed via a host of buttons 810 and 820. The buttons allow the user to select for example, the type or brand of vacuum tube amplifier to be emulated in each of the two channels. In addition, various tone controls are provided, namely drive, bass, mid, treble, presence, and volume. Additionally, controls for effects such as stomp box, tremolo, noise gate, dynamic compressor, equalization, loop, pitch shift, delay, and reverb are also provided. The signal routing through the channels is depicted on a user display 840. As an alternative or in addition to using the buttons on the front panel of the housing 885, a foot pedal 870 may also be used for additional control, such as control of the volume or other audio effects. Any conventional electronics may be used to manage the user display 840 and the input from the various buttons 810 and 820 of the instrument amplifier.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method comprising:

simultaneously generating first and second digital audio signals based on the same digital audio input signal, the first digital audio signal being generated by one of (1) delaying the digital audio input signal in accordance with a random variable delay amount, (2) randomly changing a pitch of the first digital audio signal relative to that of the digital audio input signal, and (3) randomly changing a gain factor of the first digital audio signal, as a function of the digital audio input signal; and generating a sound that reflects a combination of the first and second digital audio signals.

2. The method of claim 1 wherein one of changing the variable delay amount, changing the pitch, and changing the gain factor is in response to detecting an attack in the digital audio input signal.

3. The method of claim 2 wherein the digital audio input signal is a digitized electric guitar signal.

4. The method of claim 1 wherein the first digital audio signal is generated according to a plurality of parameters that control the delaying, pitch changing, and gain changing, and wherein none of the plurality of parameters is changed unless an attack is detected in the digital audio input signal.

5. The method of claim 1 wherein the first digital audio signal is generated according to a plurality of randomly distributed parameters that control the delaying, pitch changing, and gain changing.

* * * * *